US011691424B2

(12) United States Patent
Kamimura et al.

(10) Patent No.: US 11,691,424 B2
(45) Date of Patent: Jul. 4, 2023

(54) LIQUID EJECTION HEAD, AND LIQUID EJECTION DEVICE

(71) Applicant: CANON KABUSHIKI KAISHA, Tokyo (JP)

(72) Inventors: Takayuki Kamimura, Kanagawa (JP); Michiko Johnson, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 17/511,096

(22) Filed: Oct. 26, 2021

(65) Prior Publication Data

US 2022/0134755 A1 May 5, 2022

(30) Foreign Application Priority Data

Oct. 30, 2020 (JP) ..... 2020-182084

(51) Int. Cl.
*B41J 2/16* (2006.01)

(52) U.S. Cl.
CPC ..... *B41J 2/1623* (2013.01); *B41J 2/1626* (2013.01)

(58) Field of Classification Search
CPC ..... B41J 2/1623; B41J 2/1626; B41J 2/055; B41J 2/14145; B41J 2202/12
See application file for complete search history.

(56) References Cited

U.S. PATENT DOCUMENTS

2019/0291434 A1* 9/2019 Uchida ..... B41J 2/14233

FOREIGN PATENT DOCUMENTS

JP H07148926 A 6/1995

OTHER PUBLICATIONS

IP.com search (Year: 2023).*

* cited by examiner

*Primary Examiner* — Lisa Solomon
(74) *Attorney, Agent, or Firm* — Canon U.S.A., Inc., IP Division

(57) ABSTRACT

A liquid ejection head that includes ejection orifices and is configured by bonding a silicon substrate and a support substrate, flow passages which penetrate a bonding surface between the silicon substrate and the support substrate and through which different types of liquids flow. An in-partition wall space that is open to the bonding surface between the silicon substrate and the support substrate is formed in a partition wall for separating the flow passages. The internal pressure of the in-partition wall space is set to be lower than pressure of the liquid on each of the flow passages.

15 Claims, 7 Drawing Sheets

LIQUID EJECTION HEAD, AND LIQUID EJECTION DEVICE

BACKGROUND OF THE INVENTION

Field of the Invention

The present disclosure relates to a liquid ejection head configured by bonding a plurality of substrates, and a liquid ejection device using the liquid ejection head.

Description of the Related Art

For a liquid ejection head that ejects a liquid from an ejection orifice, there is a liquid ejection head provided with a plurality of ejection orifices to eject different types of liquids from the respective ejection orifices. One example is an ink jet recording head that is used in an ink jet recording device and ejects recording liquids, that is, inks of a plurality of colors. In such a liquid ejection head, it is necessary to suppress mixing of different types of liquids to be ejected. However, in a liquid ejection head in which substrates are laminated and a flow passage of a liquid is formed in the laminated substrates, different types of liquids may be mixed through defects such as gaps occurring between the substrates. This means that, in the case of an ink jet recording head, inks of different colors are mixed before ejection, resulting in deterioration of recording image quality. Japanese Patent Application Laid-Open No. H07-148926 discloses that a separation groove is provided in a partition wall that separates flow passages for each type of liquid, and a sealing material is injected into the separation groove, and thus permeation and diffusion of the liquid from the gaps between the substrates is prevented.

In the technique disclosed in Japanese Patent Application Laid-Open No. H07-148926, due to aged deterioration and the like of the sealing material injected into the separation groove, the gap may occur between the substrates constituting the liquid ejection head, and there is still a concern that the different types of liquids to be ejected are mixed.

SUMMARY OF THE INVENTION

According to the present disclosure, there is provided a liquid ejection head configured by bonding a plurality of substrates. The liquid ejection head includes an ejection orifice from which a liquid is ejected, a first flow passage which penetrates a bonding surface between the plurality of substrates and through which a liquid flows, a second flow passage which penetrates the bonding surface and through which a liquid different from the liquid flowing through the first flow passage flows, and an in-partition wall space which is provided in a partition wall for separating the first flow passage and the second flow passage and is open to the bonding surface. An internal pressure of the in-partition wall space is lower than any of pressures of the liquids in the first flow passage and the second flow passage.

Further features of the present disclosure will become apparent from the following description of exemplary embodiments with reference to the attached drawings.

DESCRIPTION OF THE EMBODIMENTS

An aspect of the present disclosure is to provide a liquid ejection head capable of suppressing mixing of different types of liquids to be ejected, for example, inks of different colors, and a liquid ejection device in which such a liquid ejection head is mounted.

Next, embodiments of the present disclosure will be described with reference to the drawings. The embodiments described below do not limit the present disclosure, and the features of each of a plurality of embodiments can be combined.

Figure 1A:
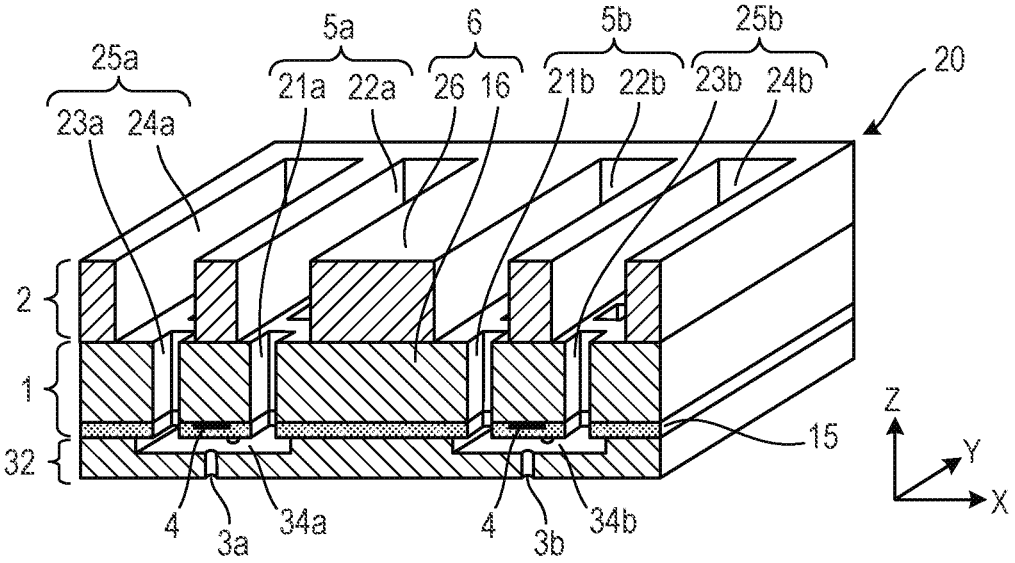
FIG. 1A is a perspective view of a liquid ejection head.
Figure 1B:
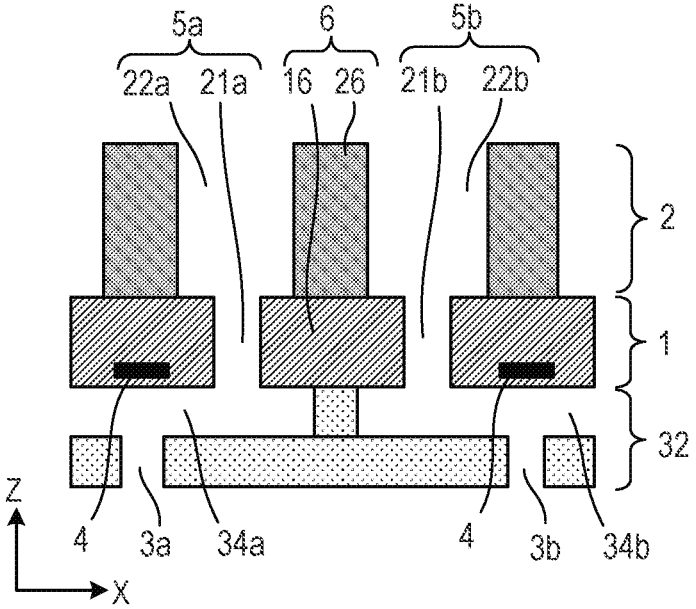
FIG. 1B is a cross-sectional view of the liquid ejection head.

Before describing a liquid ejection head based on the present disclosure, a general configuration of the liquid ejection head will be described. FIGS. 1A and 1B are views illustrating a configuration of an example of a general liquid ejection head. FIG. 1A is a partially-broken perspective view of the liquid ejection head. FIG. 1B is a schematic cross-sectional view of the main portion of the liquid ejection head. A liquid ejection head 20 illustrated in FIG. 1A ejects two different types of liquids, for example, inks of different colors from the respective ejection orifices. The liquid ejection head is configured by bonding a silicon substrate 1 and a support substrate 2. Because the silicon substrate 1 and the support substrate 2 are bonded to each other, the liquid ejection head 20 is configured by two substrates. The support substrate 2 itself can be also configured by bonding a plurality of substrates. In this case, the liquid ejection head 20 is configured by laminating and bonding three or more substrates.

In FIG. 1A, the left-right direction is set to an X-direction, a direction in which the silicon substrate 1 and the support substrate 2 are bonded to each other is set to a Z-direction, and a direction perpendicular to both the X-direction and the Z-direction is set to a Y-direction. Assuming that the two different types of liquids are a first liquid and a second liquid, in the example illustrated here, an ejection orifice 3*a* of the first liquid is disposed on the left side in the X-direction, and an ejection orifice 3*b* of the second liquid is disposed on the right side. In practice, a plurality of ejection orifices 3*a* of the first liquid is provided to be arranged in the Y-direction. Similarly, a plurality of ejection orifices 3*b* of the second liquid is provided to be arranged in the Y-direction. When the liquid ejection head 20 is generally used, the ejection orifices 3*a* and 3*b* are directed downward in a gravity direction. Thus, the illustrated downward direction in the Z-direction is the gravity direction. The silicon substrate 1 is disposed below the support substrate 2 in the illustrated Y-direction. Further, for example, a plurality of recording elements 4 which are electrothermal converters are formed on one surface (lower surface in FIG. 1A) of the silicon substrate 1. The support substrate 2 is bonded to the other surface of the silicon substrate 1. A protective layer 31 is provided on one surface of the silicon substrate 1, and the recording element 4 is covered with the protective layer 31. An ejection-orifice forming member 32 in which the ejection orifices 3*a* and 3*b* are formed is provided on one surface of the silicon substrate 1. The ejection orifices 3*a* and 3*b* are disposed at positions facing the recording element 4, respectively. A region sandwiched between the ejection orifice 3*a* and the recording element 4 corresponds to a pressure chamber 34*a* for the first liquid. A region sandwiched between the ejection orifice 3*b* and the recording element 4 corresponds to a pressure chamber 34*b* for the second liquid. When the liquids are supplied to the pressure chambers 34*a* and 34*b*, and recording element 4 is driven in this state, the liquids in the pressure chambers 34*a* and 34*b*, for example, foam, and the liquids are ejected from the ejection orifices 3*a* and 3*b* as droplets by the energy.

In order to supply liquids to be ejected, to the pressure chambers 34*a* and 34*b*, a flow passage is provided in the support substrate 2 and the silicon substrate 1. In the liquid ejection head 20 illustrated here, through-flow passages 21*a* and 23*a* provided for each ejection orifice 3*a* to penetrate the silicon substrate 1 are connected to the pressure chamber 34*a* of the first liquid. The liquid is supplied from one of the through-flow passages 21*a* and 23*a* to the pressure chamber 34*a*. The liquid that has not been ejected from the ejection orifice 3*a* is recovered from the other of the through-flow passages 21*a* and 23*a*. Thus, a flow of the liquid is normally formed in the pressure chamber 34*a*. The through-flow passages 21*a* and 23*a* for each ejection orifice 3*a* communicate with flow-passage grooves 22*a* and 24*a* formed to extend in the Y-direction in the support substrate 2 in common to the ejection orifice 3*a*, respectively. Similarly, through-flow passages 21*b* and 23*b* that penetrate the silicon substrate 1 are connected to the pressure chamber 34*b* of the second liquid, and the through-flow passages 21*b* and 23*b* communicate with flow-passage grooves 22*b* and 24*b* formed in the support substrate 2. Regarding the first liquid, the through-flow passage 21*a* and the flow-passage groove 22*a* form one continuous flow passage 5*a* as a whole. The through-flow passage 23*a* and the flow-passage groove 24*a* also form one continuous flow passage 25*a* as a whole. The flow passages 5*a* and 25*a* penetrate a bonding surface between the silicon substrate 1 and the support substrate 2. Similarly, regarding the second liquid, the through-flow passage 21*b* and the flow-passage groove 22*b* form a flow passage 5*b*, and the through-flow passage 23*b* and the flow-passage groove 24*b* also form a flow passage 25*b*. The flow passages 5*b* and 25*b* penetrate the bonding surface between the silicon substrate 1 and the support substrate 2. When viewed from the bonding surface, the silicon substrate 1 and the support substrate 2 are substrates located on both sides of the bonding surface. In the following description, it is assumed that the flow passage 5*a* and the flow passage 5*b* are adjacent to each other with a partition wall 6 interposed between the flow passage 5*a* and the flow passage 5*b*, in the liquid ejection head 20. Because the flow passage 5*a* and the flow passage 5*b* are adjacent to each other with the partition wall 6 interposed between the flow passage 5*a* and the flow passage 5*b*, one of the flow passages 5*a* and 5*b* corresponds to a first flow passage in the present disclosure, and the other corresponds to a second flow passage. The partition wall 6 includes a partition wall portion 16 and a partition wall portion 26. The partition wall portion 16 separates the through-flow passages 21*a* and 21*b* in the silicon substrate 1. The partition wall portion 26 separates the flow-passage grooves 22*a* and 22*b* in the support substrate 2. FIG. 1B illustrates the main portion of the liquid ejection head 20 including the ejection orifices 3*a* and 3*b*, the flow passages 5*a* and 5*b* and the partition wall 6.

Both the flow passage 5*a* of the first liquid and the flow passage 5*b* of the second liquid penetrate the bonding surface between the silicon substrate 1 and the support substrate 2. Here, if liquid leakage and liquid permeation does not occur through the bonding surface between the silicon substrate 1 and the support substrate 2, more specifically, the bonding surfaces of the partition wall portions 16 and 26, the first liquid and the second liquid are not mixed. In practice, when there is a defect such as poor bonding, liquid leakage or liquid permeation may occur through the bonding surface between the silicon substrate 1 and the support substrate 2, and thus the first liquid and the second liquid may be mixed. If the first liquid and the second liquid are mixed, for example, if a black ink is mixed with an ink of a high-brightness color, the recording quality is deteriorated when the ink having high brightness is ejected for recording. Therefore, in the liquid ejection head 20, an in-partition wall space 7 that is open to the bonding surface between the silicon substrate 1 and the support substrate 2 is formed in the partition wall 6, and the internal pressure of the in-partition wall space 7 is set to be lower than the pressure of the liquid in any of the flow passages 5*a* and 5*b*. Even though the liquid permeates through the bonding surface between the silicon substrate 1 and the support substrate 2, the internal pressure of the in-partition wall space 7 is lower than the pressure of the liquid in the flow passages 5*a* and 5*b*, and thus the permeated liquid is drawn into the in-partition wall space 7 and dammed in the in-partition wall space. Thus, the liquid ejection head 20 suppresses the mixing of the first liquid and the second liquid in the flow passages 5*a* and 5*b*. Embodiments of the liquid ejection head based on the present disclosure will be described below. When both the first liquid and the second liquid flow into the in-partition wall space 7, the liquids are mixed, but the mixed liquids in the in-partition wall space 7 are not ejected from the ejection orifices 3*a* and 3*b*. Thus, the disadvantage of deterioration of the recording quality does not occur.

Embodiment 1

Figure 2A:
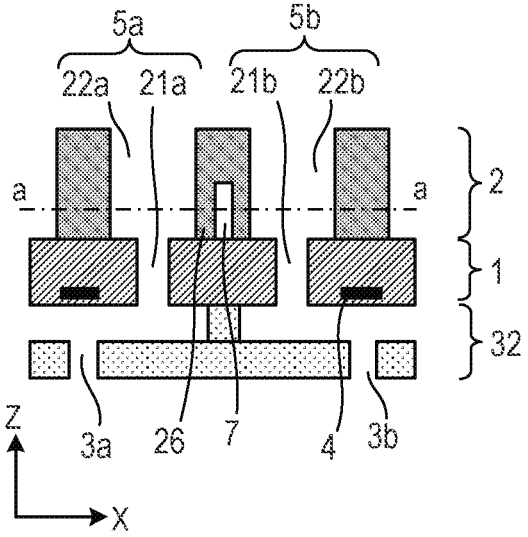
FIG. 2A is a cross-sectional view of a liquid ejection head according to Embodiment 1 of the present disclosure.
Figure 2B:
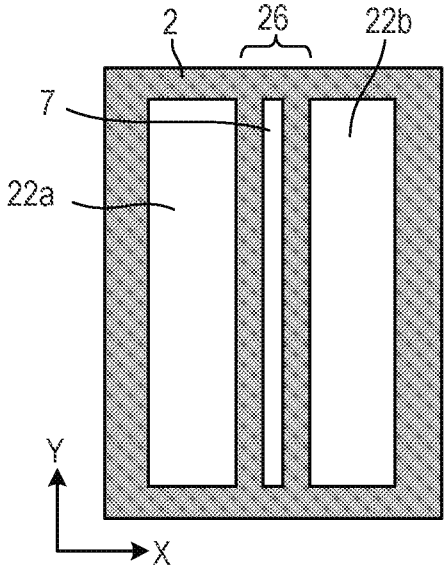
FIG. 2B is a cross-sectional view taken along line a-a in FIG. 2A.

FIGS. 2A, 2B, 2C and 2D illustrate a liquid ejection head according to Embodiment 1 of the present disclosure. FIG. 2A is a schematic cross-sectional view illustrating the main portion of the liquid ejection head in Embodiment 1. FIG. 2B is a cross-sectional view taken along line a-a in FIG. 2A. FIG. 2A illustrates the same range of the liquid ejection head as the range illustrated in FIG. 1B. An in-partition wall space 7 is formed in a partition wall portion 26 on a support substrate 2 side, and the in-partition wall space 7 is formed to reach a bonding surface between a silicon substrate 1 and the support substrate 2. That is, the in-partition wall space 7 is open to the side of the support substrate 2 on the bonding surface between the silicon substrate 1 and the support substrate 2. As illustrated in FIG. 2B, the in-partition wall space 7 extends in the Y-direction along flow-passage grooves 22*a* and 22*b* at a position being intermediate between the flow-passage grooves 22*a* and 22*b*. The in-partition wall space 7 is sealed. The internal pressure of the in-partition wall space 7 is lower than the pressure of the liquid in any of the flow passages 5*a* and 5*b*. As a result, even though the bonding surface between the silicon substrate 1 and the support substrate 2 has a minute defect causing the flow passages 5*a* and 5*b* to communicate with each other, the liquid that has permeated through the defect is drawn into the in-partition wall space 7 and dammed in the in-partition wall space. It is possible to suppress the mixing of the liquid flowing on the flow passage 5*a* and the liquid flowing on the flow passage 5*b*.

Next, a manufacturing method of the liquid ejection head illustrated in FIGS. 2A and 2B will be described. The silicon substrate 1 on which through-flow passages 21*a*, 21*b*, 23*a* and 23*b* have already been formed and the support substrate 2 on which flow-passage grooves 22*a*, 22*b*, 24*a* and 24*b* have already been formed are prepared. A positive photoresist is applied onto a surface of the support substrate 2, which is the bonding surface with the silicon substrate 1, and exposing and developing are performed in a shape illustrated in FIG. 2B. In this manner, an etching mask is formed. Then, dry etching using plasma is performed on the support substrate 2, and thus the in-partition wall space 7 is formed to be directed from the bonding surface with the silicon substrate 1 toward the inside of the support substrate 2. Using the microloading effect of dry etching, the flow-passage grooves 22*a*, 22*b*, 24*a* and 24*b* can be formed simultaneously with formation of the in-partition wall space 7. Then, by vacuum-bonding the silicon substrate 1 and the support substrate 2 in an environment of, for example, 100 Pa (absolute pressure) or less, the liquid ejection head is assembled. Vacuum bonding refers to bonding under pressure lower than atmospheric pressure. The liquid ejection head is generally used at the atmospheric pressure (0.1013 MPa) and the pressure in each of the flow passages 5*a* and 5*b* is considered to be higher than the atmospheric pressure. Thus, the pressure in the sealed in-partition wall space 7 is reliably lower than the pressure of the liquid in the flow passages 5*a* and 5*b*.

Figure 2C:
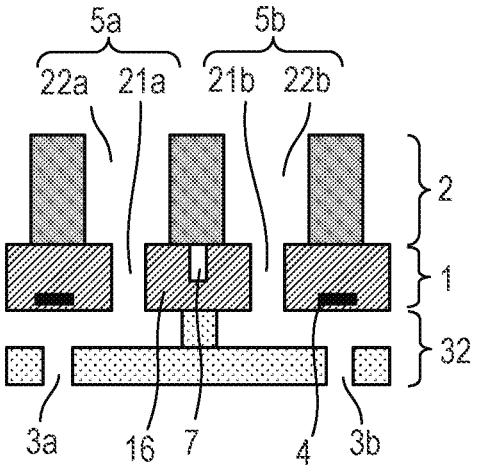
FIG. 2C is another cross-sectional view of the liquid ejection head in Embodiment 1 of the present disclosure.
Figure 2D:
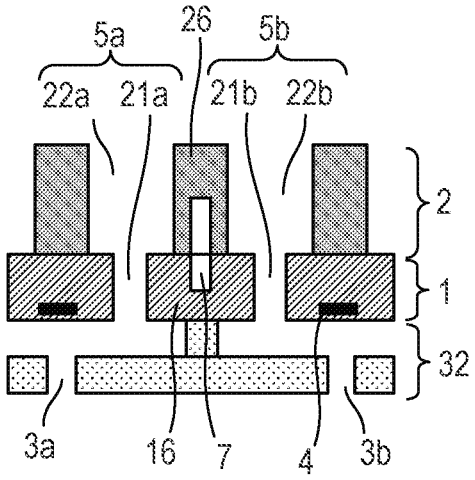
FIG. 2D is still another cross-sectional view of the liquid ejection head in Embodiment 1 of the present disclosure.

Both FIGS. 2C and 2D illustrate another example of the liquid ejection head in Embodiment 1. In Embodiment 1, when the in-partition wall space 7 is open to the bonding surface between the silicon substrate 1 and the support substrate 2, as illustrated in FIG. 2C, the in-partition wall space may be provided at the partition wall portion 16 which is not on the support substrate 2 side, but on the silicon substrate 1 side. Further, as illustrated in FIG. 2D, it is also possible to form the in-partition wall space 7 to straddle both the silicon substrate 1 and the support substrate 2 with the bonding surface interposed between the silicon substrate and the support substrate. In the above description, dry etching is used when the in-partition wall space 7 that is open to the bonding surface is formed in the support substrate 2. Dry etching can also be used when the in-partition wall space 7 is formed in the silicon substrate 1. Further, as a processing method of forming the in-partition wall space 7 in the silicon substrate 1 and the support substrate 2, wet etching and other processing methods can be used in addition to dry etching. As a method of bonding the silicon substrate 1 and the support substrate 2, a method other than vacuum bonding can be used. As a specific bonding method, one of a method of interposing a bonding material such as an adhesive and a direct bonding method that does not use an adhesive and the like can be used.

Embodiment 2

Figure 3A:
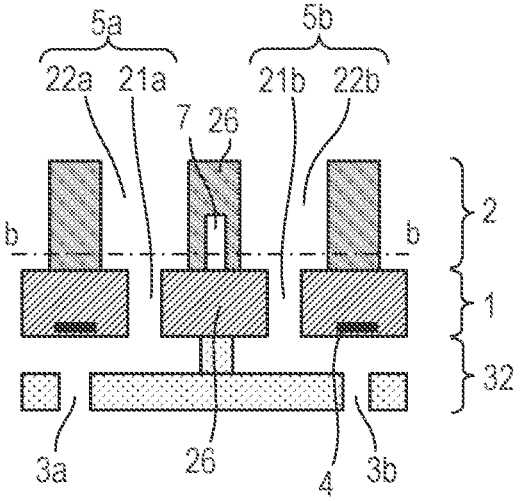
FIG. 3A is a cross-sectional view of a liquid ejection head according to Embodiment 2.
Figure 3B:
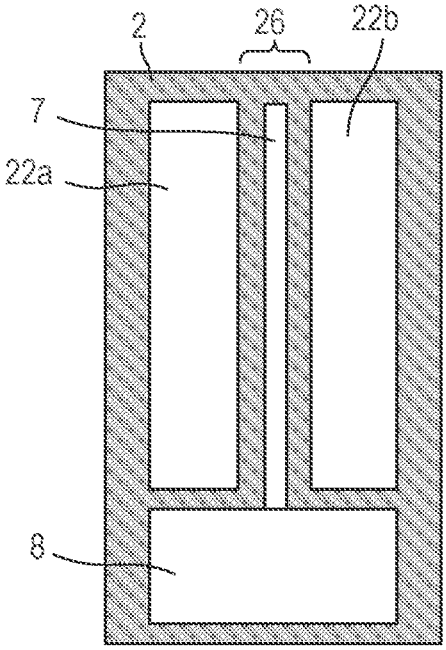
FIG. 3B is a cross-sectional view taken along line b-b in FIG. 3A.

FIGS. 3A and 3B illustrate a liquid ejection head according to Embodiment 2 of the present disclosure. FIG. 3A is a cross-sectional view of the liquid ejection head, and FIG. 3B is a cross-sectional view taken along line b-b in FIG. 3A. The liquid ejection head in Embodiment 2 is obtained by providing a liquid storage portion 8 communicating with the in-partition wall space 7 in the liquid ejection head illustrated in FIGS. 2A and 2B. The liquid storage portion 8 is provided as a space larger than the in-partition wall space 7 to be open to the bonding surface between the silicon substrate 1 and the support substrate 2 in the support substrate 2. The in-partition wall space 7 and the liquid storage portion 8 are sealed as a whole, and the internal pressure is lower than the pressure of the liquid in the flow passages 5*a* and 5*b*. Because the pressure in the in-partition wall space 7 is low, the liquid flows into the in-partition wall space 7 and is dammed in the in-partition wall space, and then flows into the liquid storage portion 8 and is stored in the liquid storage portion. In the liquid ejection head in Embodiment 1, when the in-partition wall space 7 is filled with the liquid, the effect of suppressing the mixing of the liquids is lost. However, in Embodiment 2, the effect of suppressing the mixing of the liquids is maintained until not only the in-partition wall space 7 but also the liquid storage portion 8 are filled with the liquid. Thus, according to the liquid ejection head in Embodiment 2, the effect of suppressing the mixing of different liquids is exhibited for a longer period of time. Also in the liquid ejection head in Embodiment 2, similar to Embodiment 1, the in-partition wall space 7 and the liquid storage portion 8 are formed in the support substrate 2 by dry etching. Then, the silicon substrate 1 and the support substrate 2 can be assembled by vacuum bonding.

In a liquid ejection head that ejects three or more types of liquids, for example, a liquid ejection head that ejects inks of three or four colors, the number of partition walls 6 that separate flow passages of different liquids is two or more, and the number of in-partition wall spaces 7 is also two or more. In a liquid ejection head having two or more in-partition wall spaces 7, the liquid storage portion 8 may be provided for each in-partition wall space 7. One liquid storage portion 8 may be provided in common between a plurality of in-partition wall spaces 7. In the above-described example, the liquid storage portion 8 is provided on the support substrate 2. The liquid storage portion 8 may be provided outside the silicon substrate 1 and the support substrate 2 so long as the sealing of the in-partition wall space 7 and the liquid storage portion 8 as a whole is secured. Also in the liquid ejection head illustrated in one of FIG. 2C and FIG. 2D, the liquid storage portion 8 communicating with the in-partition wall space 7 can be provided.

Embodiment 3

Figure 4A:
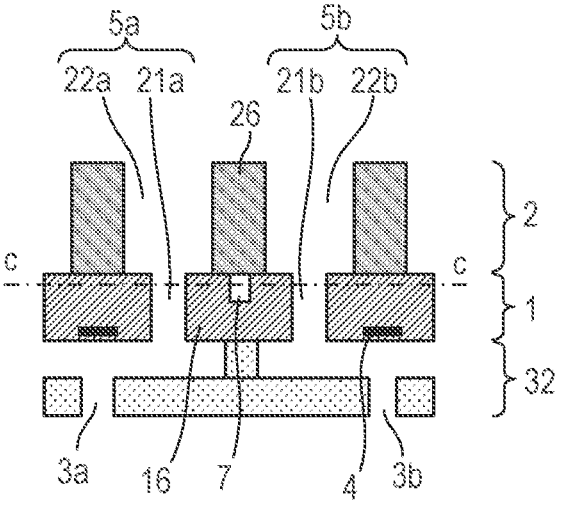
FIG. 4A is a cross-sectional view of a liquid ejection head according to Embodiment 3.
Figure 4B:
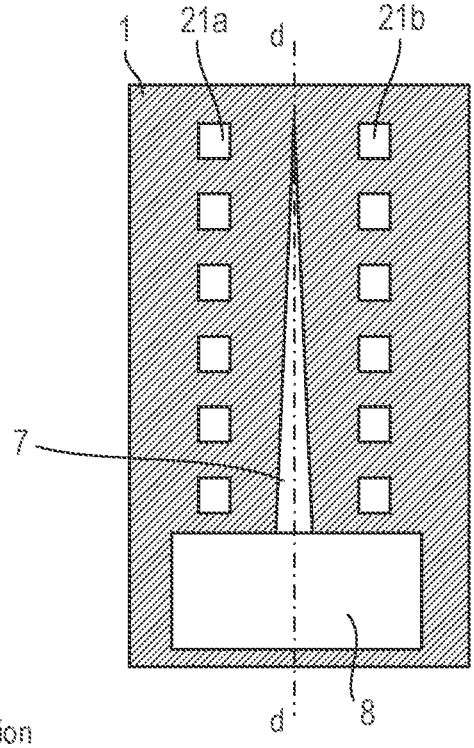
FIG. 4B is a cross-sectional view taken along line c-c in FIG. 4A.
Figure 4C:
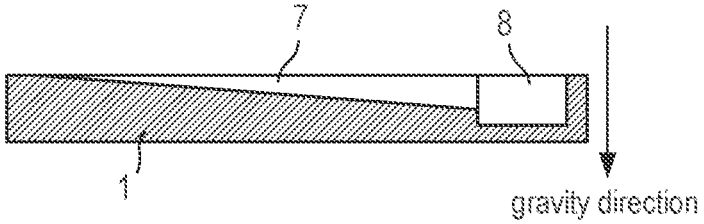
FIG. 4C is a cross-sectional view taken along line d-d in FIG. 4B.

FIGS. 4A, 4B and 4C illustrate a liquid ejection head according to Embodiment 3 of the present disclosure. FIG. 4A is a cross-sectional view of the liquid ejection head. FIG. 4B is a cross-sectional view taken along line c-c in FIG. 4A. FIG. 4C is a cross-sectional view taken along line d-d in FIG. 4B. The line d-d extends in the Y-direction. The liquid ejection head in Embodiment 3 includes the liquid storage portion 8 communicating with the in-partition wall space 7 as in Embodiment 2. However, Embodiment 3 is different from Embodiment 2 in that the in-partition wall space 7 and the liquid storage portion 8 are provided on the silicon substrate 1. The width (width in the X-direction) of the in-partition wall space 7 on the bonding surface between the silicon substrate 1 and the support substrate 2 becomes wider as the in-partition wall space becomes closer to the liquid storage portion 8. When the in-partition wall space 7 that becomes wider as the in-partition wall space becomes closer to the liquid storage portion 8 is formed by dry etching, the silicon substrate 1 is removed by etching to become deeper as the width becomes wider, by the microloading effect during etching. When the liquid ejection head is used, the silicon substrate 1 is located below the support substrate 2 in the gravity direction. Thus, as illustrated in FIG. 4C, the bottom surface of the in-partition wall space 7 is formed to be inclined downward in the gravity direction during the use, toward the liquid storage portion 8. The bottom surface of the in-partition wall space 7 referred to here is a surface of the in-partition wall space 7, which is on a lower side in the gravity direction during the use. Since the in-partition wall space 7 is inclined as described above, it is possible to guide the liquid flowing into the in-partition wall space 7, to the liquid storage portion 8 with high efficiency.

In the embodiment in FIGS. 3A and 3B, the in-partition wall space 7 having an inclination is provided in the silicon substrate 1 located below the support substrate 2 in the gravity direction when the liquid ejection head is used. Therefore, even though the pressure in the in-partition wall space 7 is not set to be lower than the pressure of the liquid in the flow passages 5*a* and 5*b*, it is possible to dam the liquid that has permeated the bonding surface between the silicon substrate 1 and the support substrate 2 in the in-partition wall space 7 and store the liquid in the liquid storage portion 8. Thus, regarding Embodiment 3, it is not essential that the pressure in the in-partition wall space 7 is set to be lower than the pressure of the liquid in the flow passages 5*a* and 5*b*.

Embodiment 4

Figure 5A:
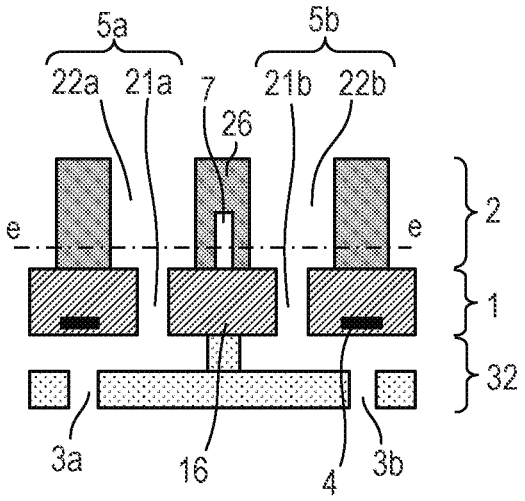
FIG. 5A is a cross-sectional view of a liquid ejection head according to Embodiment 4.
Figure 5B:
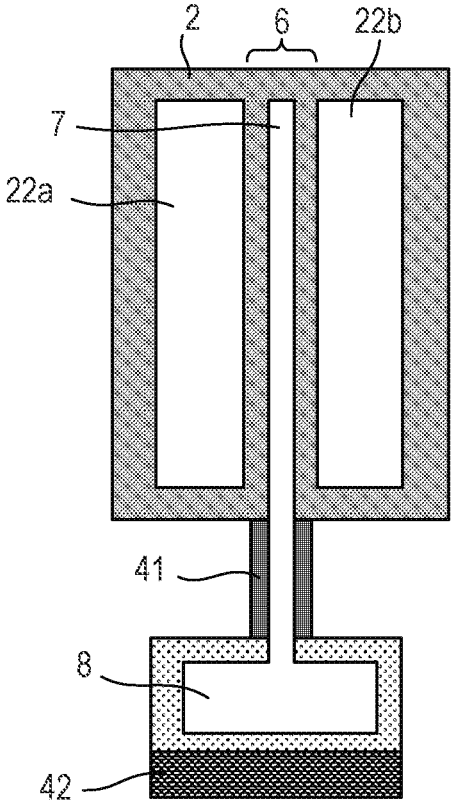
FIG. 5B is a cross-sectional view taken along line e-e in FIG. 5A.

In each of the above-described embodiments, the pressure in the in-partition wall space 7 is made sufficiently lower than the atmospheric pressure in a manner that the silicon substrate 1 and the support substrate 2 are bonded to each other by vacuum bonding. However, as a method of reducing the internal pressure of the in-partition wall space 7, methods other than vacuum bonding are provided. One of the methods uses a pressure reducing mechanism. As the pressure reducing mechanism, a mechanism of reducing the pressure by cooling or absorbing the gas in the sealed space, and a mechanism using a pump that exhausts the gas in the space to the outside are provided. When the latter pressure reducing mechanism is used, an exhaust pump is connected, and thus the in-partition wall space 7 is not in the sealed state. FIGS. 5A and 5B illustrate a liquid ejection head according to Embodiment 4 of the present disclosure. FIG. 5A is a cross-sectional view of the liquid ejection head, and FIG. 5B is a cross-sectional view taken along line e-e in FIG. 5A. The liquid ejection head in Embodiment 4 is similar to the liquid ejection head in Embodiment 2. In the liquid ejection head in Embodiment 4, the liquid storage portion 8 is provided outside the support substrate 2, and the liquid storage portion 8 can be cooled by a cooling mechanism 42 including a Peltier element and the like. The in-partition wall space 7 and the liquid storage portion 8 are connected by a drawer pipe 41. The entirety of the in-partition wall space 7, the liquid storage portion 8 and the drawer pipe 41 is sealed. When the liquid storage portion 8 is cooled by the cooling mechanism 42, the pressure of the gas in the liquid storage portion 8 is reduced, and the internal pressure of the in-partition wall space 7 communicating with the liquid storage portion 8 is also reduced with the above pressure being reduced. In the liquid ejection head in Embodiment 4, because the cooling mechanism 42 cools the liquid storage portion 8, it is possible to set the pressure in the in-partition wall space 7 to be lower than the pressure of the liquid in the flow passages 5*a* and 5*b*. Similar to the above-described embodiments, it is possible to suppress the mixing of the first liquid and the second liquid.

In Embodiment 4, the liquid storage portion 8 can be provided on one of the silicon substrate 1 and the support substrate 2 and the cooling mechanism 42 can be provided in the liquid storage portion. In this case, the drawer pipe 41 is not provided. The drawer pipe 41 also has a heat insulating function. Thus, when the drawer pipe 41 is not provided, a heat insulating structure may be separately provided in order to suppress excessive cooling of the liquid to be ejected. A backflow prevention mechanism such as a backflow prevention valve may be provided at a connection portion between the in-partition wall space 7 and the drawer pipe 41. By providing the backflow prevention mechanism, it is possible to suppress an increase of the internal pressure of the in-partition wall space 7 when the cooling mechanism 42 does not operate, or an occurrence of backflow of the liquid in the liquid storage portion 8 into the in-partition wall space 7.

Embodiment 5

Figure 6A:
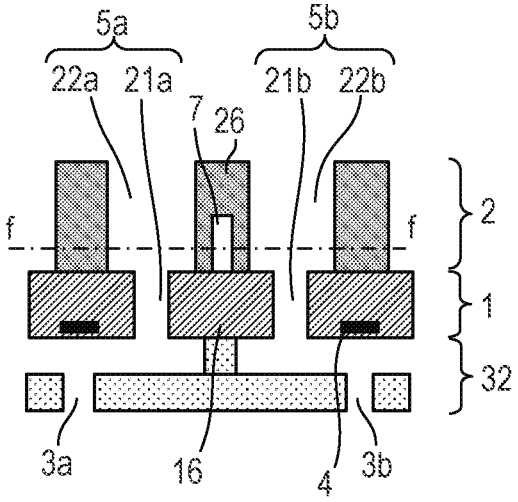
FIG. 6A is a cross-sectional view of a liquid ejection head according to Embodiment 5.
Figure 6B:
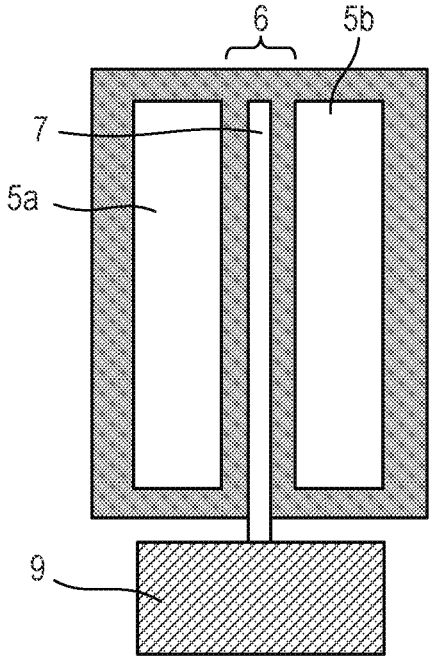
FIG. 6B is a cross-sectional view taken along line f-f in FIG. 6A.

FIGS. 6A and 6B illustrate a liquid ejection head according to Embodiment 5 of the present disclosure. FIG. 6A is a cross-sectional view of the liquid ejection head, and FIG. 6B is a cross-sectional view taken along line f-f in FIG. 6A. The liquid ejection head in Embodiment 5 is similar to the liquid ejection head illustrated in FIGS. 2A and 2B, but is different from the liquid ejection head illustrated in FIGS. 2A and 2B in that a pump 9 connected to the in-partition wall space 7 is provided. The pump 9 communicates with the in-partition wall space 7 to suck the gas in the in-partition wall space 7 and discharge the gas to the outside, so that the pressure in the in-partition wall space 7 is maintained to be lower than the pressure of the liquid in the flow passages 5*a* and 5*b*. The pump 9 is provided outside the support substrate 2, for example. Although the in-partition wall space 7 is not the sealed space due to the provision of the pump 9, it is also possible to suppress the mixing of the first liquid and the second liquid, in the present embodiment. Even in the configuration illustrated in one of FIG. 2C and FIG. 2D, the pump 9 is connected, so that it is possible to maintain the pressure in the in-partition wall space 7 to be lower than the pressure of the liquid in the flow passages 5*a* and 5*b*.

Embodiment 6

Figure 7:
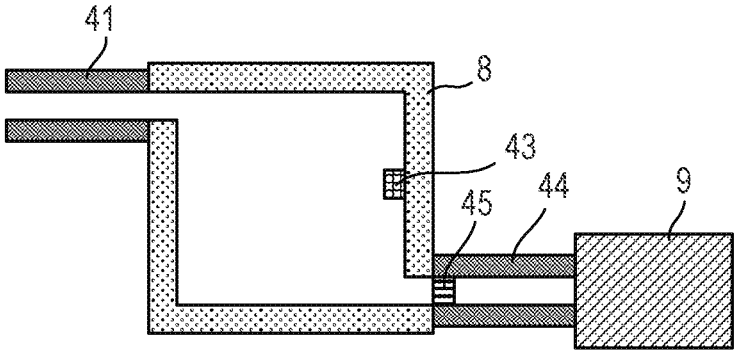
FIG. 7 is a view illustrating an example of a pressure reducing mechanism.

Also in the liquid ejection head provided with the liquid storage portion 8 communicating with the in-partition wall space 7 as described in one of Embodiment 2 and Embodiment 3, the pump 9 is connected, and thus it is possible to set the pressure in the in-partition wall space 7 to be lower than the pressure of the liquid in the flow passages 5*a* and 5*b*. FIG. 7 is a cross-sectional view illustrating a liquid ejection head according to Embodiment 6. FIG. 7 illustrates a connection form of the pump 9 with the liquid storage portion 8 when the liquid storage portion 8 is connected to the in-partition wall space 7 via the drawer pipe 41. The pump 9 is connected to the liquid storage portion 8 via a pipe 44. Thus, the pump 9 communicates with the in-partition wall space 7, and the in-partition wall space 7 sucks and exhausts the gas via the liquid storage portion 8 and the drawer pipe 41. At this time, the liquid stored in the liquid storage portion 8 may be sucked by the pump 9 and discharged to the outside. Further, in the form illustrated in FIG. 7, an on-off valve 45 is provided at a position at which the pipe 44 is attached to the liquid storage portion 8, and a sensor 43 is provided in the liquid storage portion 8. When the sensor 43 is a liquid level sensor, the sensor 43 can detect that a certain amount of liquid has flowed into and stored in the liquid storage portion 8, and thus opening/closing of the on-off valve 45 and the drive of the pump 9 are controlled. The drive of the pump 9 is controlled, for example, by controlling the power on/off of the pump 9. When the sensor 43 is a pressure sensor, it is possible to control the drive of the pump 9 in accordance with the pressure detected by the sensor 43, and control the opening/closing of the on-off valve 45 in synchronization with the drive of the pump 9. It is possible to control the drive of the pump 9 by using a management index other than the liquid level and the pressure in the liquid storage portion 8. In addition, it is possible to control the drive of the pump 9 by combining a plurality of management indices. Here, the liquid storage portion 8 is connected to the in-partition wall space 7 via the drawer pipe 41. The pump 9 may be connected to the liquid storage portion 8 formed on one of the silicon substrate 1 and the support substrate 2.

Embodiment 7

Figure 8A:
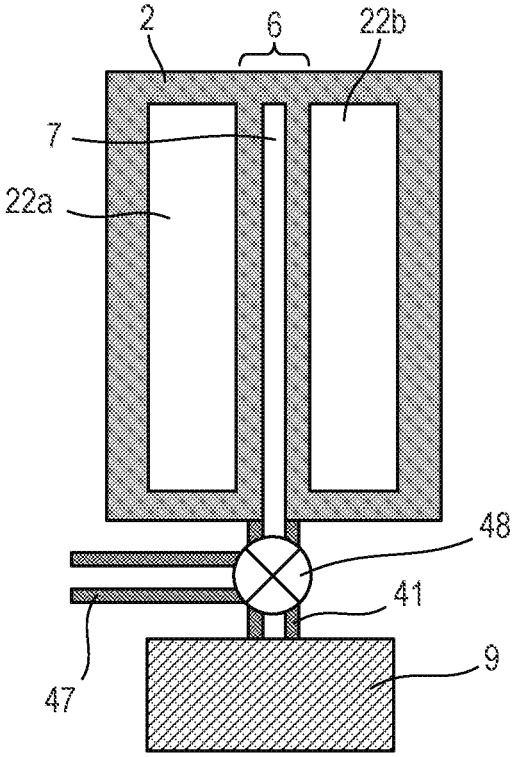
FIG. 8A is a view illustrating a liquid ejection head according to Embodiment 7.
Figure 8B:
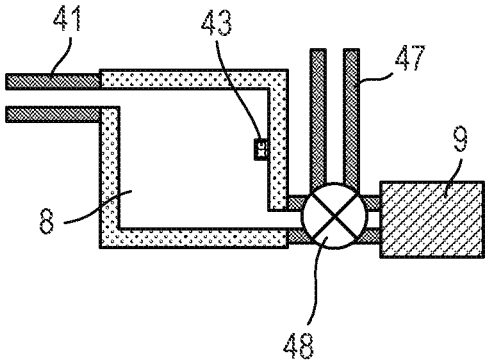
FIG. 8B is a view illustrating the liquid ejection head in Embodiment 7.

When the pump 9 is provided in the liquid ejection head in each of the above-described embodiments, a multi-directional on-off valve such as a three-way valve can be provided on an inlet side of the pump 9, that is, at a position at which one of the in-partition wall space 7 and the liquid storage portion 8 is connected with the pump 9. FIGS. 8A and 8B illustrate a liquid ejection head in Embodiment 7 of the present disclosure. FIG. 8A illustrates that a multi-directional on-off valve 48 is provided in the middle of the drawer pipe 41 when the pump 9 is connected to the in-partition wall space 7 via the drawer pipe 41. Another pipe 47 is connected to the multi-directional on-off valve 48. FIG. 8B illustrates that the multi-directional on-off valve 48 is provided between the liquid storage portion 8 and the pump 9 when the pump 9 is connected to the liquid storage portion 8. A pipe 47 is connected to the multi-directional on-off valve 48. In either case of FIGS. 8A and 8B, the pipe 47 connected to the multi-directional on-off valve 48 can be connected to one of another in-partition wall space 7 and another liquid storage portion 8. Because a plurality of in-partition wall spaces 7 and liquid storage portions 8 is connected to the multi-directional on-off valve 48, a single pump 9 can communicate with the plurality of in-partition wall spaces 7 and liquid storage portions 8, and can perform suction from the plurality of in-partition wall spaces 7 and liquid storage portions 8 by using the pump 9. In this case, an opening direction of the multi-directional on-off valve 48 is controlled based on one of the pressure and the liquid level in the liquid storage portion 8, so suction may be performed from one of one specific in-partition wall space 7 and one specific liquid storage portion 8. Alternatively, suction may be performed from all the in-partition wall spaces 7 and liquid storage portions 8. Further, the suction of the plurality of in-partition wall spaces 7 may be performed at a certain time point, and the suction of the plurality of liquid storage portions 8 may be performed at another time point.

If at least one of the in-partition wall space 7 and the liquid storage portion 8 is connected to the multi-directional on-off valve 48 provided on the inlet side of the pump 9, the multi-directional on-off valve 48 may communicate with a space that is neither the in-partition wall space 7 nor the liquid storage portion 8, for example, via the pipe 47. For example, when a bubble storage space for storing bubbles generated in the liquid in the flow passages 5*a*, 5*b* and the like is provided in the liquid ejection head, the bubble storage space and the pump 9 may communicate with each other via the multi-directional on-off valve 48. In this case, by controlling the opening direction of the multi-directional on-off valve 48, it is possible to perform switching between the time when the pump 9 communicates with the bubble storage space and the time when the pump 9 communicates with one of the in-partition wall space 7 and the liquid storage portion 8. Thus, with the action of the pump 9, it is possible to perform switching between sucking out of bubbles in the flow passages 5*a*, 5*b* and the like and drawing of the liquid into the decompressed in-partition wall space 7.

Embodiment 8

Figure 9A:
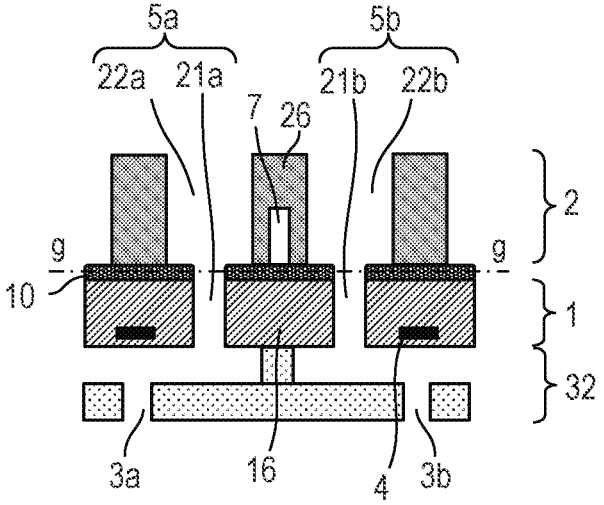
FIG. 9A is a cross-sectional view of a liquid ejection head according to Embodiment 8.
Figure 9B:
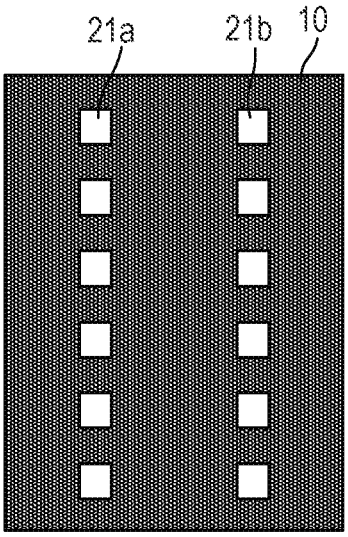
FIG. 9B is a cross-sectional view taken along line g-g in FIG. 9A.
Figure 9C:
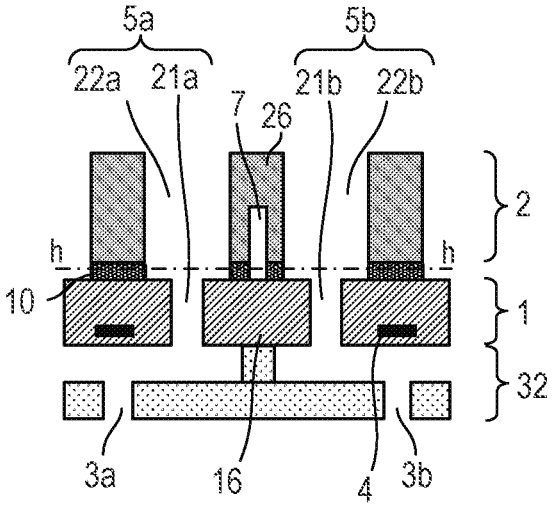
FIG. 9C is another cross-sectional view of the liquid ejection head in Embodiment 8.
Figure 9D:
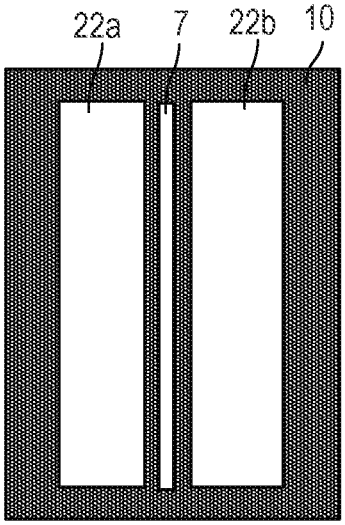
FIG. 9D is a cross-sectional view taken along line h-h in FIG. 9C.

FIGS. 9A, 9B, 9C and 9D are views illustrating a liquid ejection head in Embodiment 8. FIGS. 9A and 9C are schematic cross-sectional views of the liquid ejection head. FIG. 9B is a cross-sectional view taken along line g-g in FIG. 9A. FIG. 9D is a cross-sectional view taken along line h-h in FIG. 9C. In the liquid ejection head, a substrate bonding member 10 may be used to bond the silicon substrate 1 and the support substrate 2. FIGS. 9A, 9B, 9C and 9D illustrate a case where the substrate bonding member 10 is used to bond the silicon substrate 1 and the support substrate 2 in the liquid ejection head illustrated in FIGS. 2A and 2B. The substrate bonding member 10 is made of, for example, a dry film. At this time, as illustrated in FIGS. 9A and 9B, it is assumed that the substrate bonding member 10 is patterned in a shape in which an opening (that is, through-flow passages 21*a* and 21*b*) portion in the silicon substrate 1 is removed. In this case, the silicon substrate 1 is not exposed in the in-partition wall space 7, and it is not possible for the in-partition wall space 7 to draw only the liquid that permeates through a defect existing at an interface between the support substrate 2 and the substrate bonding member 10. Thus, there remains a possibility that the first liquid and the second liquid are mixed through a defect existing at an interface between the silicon substrate 1 and the substrate bonding member 10. Therefore, in Embodiment 8, as illustrated in FIGS. 9C and 9D, a photosensitive and dry-filmed substrate bonding member 10 is tented on the surface of the support substrate 2, which is used for bonding with the silicon substrate 1. Then, the substrate bonding member 10 is exposed and developed in a shape illustrated in FIG. 9D to remove not only a portion being the flow-passage grooves 22*a* and 22*b* but also the substrate bonding member 10 in a portion being the in-partition wall space 7. Thus, the substrate bonding member 10 does not exist at a boundary surface between the in-partition wall space 7 and the silicon substrate 1, and a portion of the surface of the silicon substrate 1 is exposed into the in-partition wall space 7. It is possible to draw the liquid that has permeated through a boundary surface between the silicon substrate 1 and the substrate bonding member 10, into the in-partition wall space 7 and dam the liquid.

In the present embodiment, the layer of the substrate bonding member 10 may be formed by transfer. When the substrate bonding member 10 is removed corresponding to the position of the in-partition wall space 7, it is not necessary to completely remove the substrate bonding member 10 in the portion corresponding to the in-partition wall space 7, and at least a portion of the surface of the silicon substrate 1 during bonding may be exposed to the in-partition wall space 7. In the description using FIGS. 9A, 9B, 9C and 9D, the in-partition wall space 7 is formed on the side of the support substrate 2. The present embodiment can also be applied to a case where the in-partition wall space 7 is formed in the silicon substrate 1. Also in this case, the layer of the substrate bonding member 10 is formed so that at least a portion of the surface of the silicon substrate 1 and at least a portion of the surface of the support substrate 2 are exposed into the in-partition wall space 7. Similarly, when the substrate bonding member 10 is used to bond the silicon substrate 1 and the support substrate 2 in the liquid ejection head including the liquid storage portion 8 as described in Embodiment 2 to Embodiment 4, both the silicon substrate 1 and the support substrate 2 may be exposed into the in-partition wall space 7.

Embodiment 9

Figure 10A:
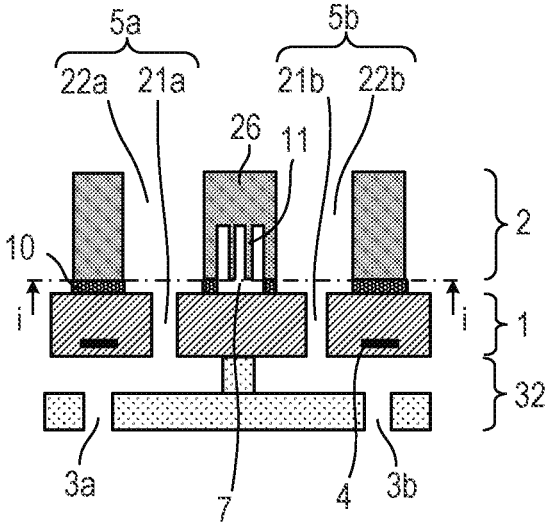
FIG. 10A is a cross-sectional view of a liquid ejection head according to Embodiment 9.
Figure 10B:
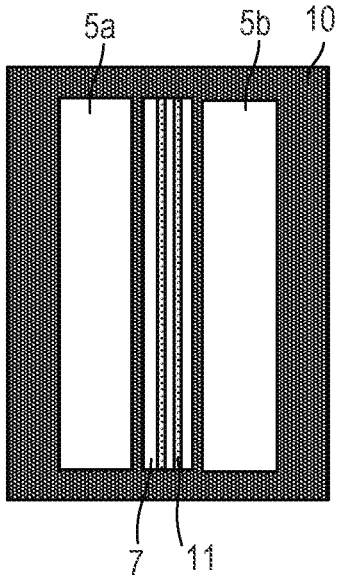
FIG. 10B is a cross-sectional view taken along line i-i in FIG. 10A.

FIGS. 10A and 10B are views illustrating a liquid ejection head in Embodiment 9. FIGS. 10A and 10B are schematic cross-sectional views of the liquid ejection head. FIG. 10B is a cross-sectional view taken along line i-i in FIG. 10A.

When the silicon substrate 1 and the support substrate 2 are bonded by using the substrate bonding member 10 as in Embodiment 8, there is a possibility that the substrate bonding member 10 during bonding enters into the in-partition wall space 7 depending on the material of the substrate bonding member 10. If the in-partition wall space 7 is buried by the substrate bonding member 10, it is not possible to exhibit the effect of the present disclosure in that mixing of the first liquid and the second liquid is prevented. Therefore, in the liquid ejection head in Embodiment 9, a plurality of separation walls 11 are provided in the in-partition wall space 7, and thus entering of the substrate bonding member 10 into the in-partition wall space 7 is minimized. The separation wall 11 has a ridge-like shape extending in a direction (Y-direction) in which the in-partition wall space 7 extends, and partially separates the in-partition wall space 7. In a case where the separation wall 11 is provided as described above, when the silicon substrate 1 and the support substrate 2 are bonded to each other, the substrate bonding member 10 is unlikely to enter into a space sandwiched by two adjacent separation walls 11. Because such a space remains, the function of the in-partition wall space 7 in that the permeated liquid is drawn and dammed is maintained, and thus it is possible to prevent the mixing of the first liquid and the second liquid.

(Liquid Ejection Device)

Figure 11:
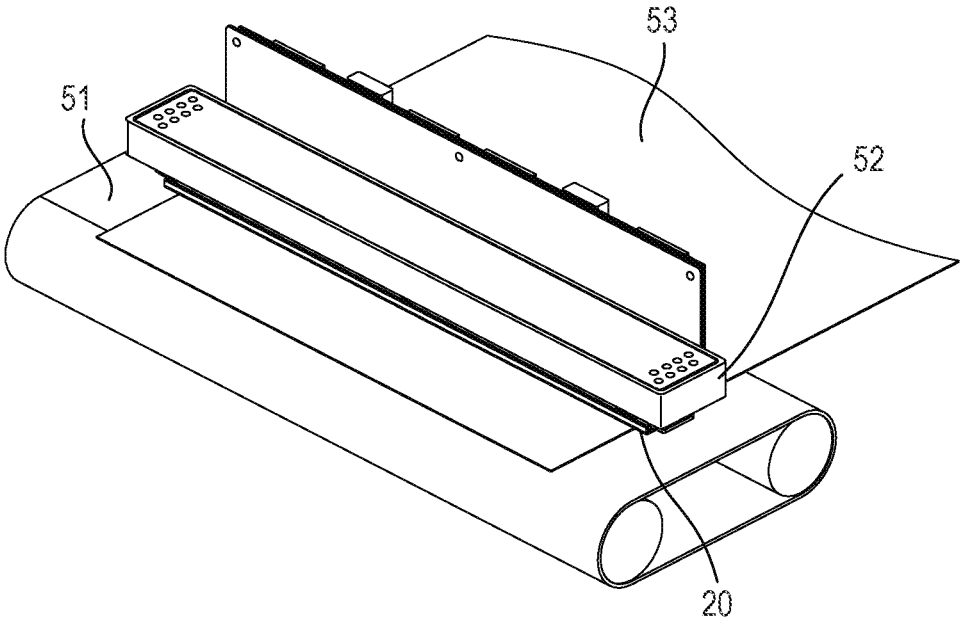
FIG. 11 is a perspective view illustrating a liquid ejection device.

The liquid ejection head in the above-described embodiments can be used in a liquid ejection device. FIG. 11 is a perspective view of an example of the liquid ejection device. The liquid ejection device is configured as an ink jet recording device that ejects an ink as a liquid from an ejection orifice to perform recording on a recording medium 53. The liquid ejection device includes a transport unit 51 that transports the recording medium 53 and a holding unit 52 disposed substantially perpendicular to a transport direction of the recording medium 53. The liquid ejection head 20 based on the present disclosure is attached to a lower surface of the holding unit 52 to face the recording medium 53. The recording medium 53 is, for example, cut paper, but may be continuous roll paper and the like in addition to the cut paper. The liquid ejection head 20 ejects inks of two or more different colors, for example, inks of colors of cyan (C), magenta (M), yellow (Y) and black (K) to enable recording on the recording medium 53 in full color. In the liquid ejection device, by using the liquid ejection head 20 based on the present disclosure, mixing of inks of different colors does not occur in the liquid ejection head 20. Thus, it is possible to perform recording on the recording medium 53 in full color with improved image quality.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-182084, filed Oct. 30, 2020, which is hereby incorporated by reference herein in its entirety.

What is claimed is:

1. A liquid ejection head configured by bonding a plurality of substrates, the head comprising:

an ejection orifice from which a liquid is ejected;

a first flow passage which penetrates a bonding surface between the plurality of substrates and through which a liquid flows;

a second flow passage which penetrates the bonding surface and through which a liquid different from the liquid flowing through the first flow passage flows; and an in-partition wall space which is provided in a partition wall for separating the first flow passage and the second flow passage and is open to the bonding surface, wherein an internal pressure of the in-partition wall space is lower than any of pressures of the liquids in the first flow passage and the second flow passage.

2. The liquid ejection head according to claim 1, wherein a substrate bonding member that bonds the substrates on both sides of the bonding surface is disposed on the bonding surface.

3. The liquid ejection head according to claim 1, wherein at least a portion of each of the substrates on both sides of the bonding surface is exposed in the in-partition wall space.

4. The liquid ejection head according to claim 1, further comprising:

a liquid storage portion that stores the liquid flowing into the in-partition wall space and communicates with the in-partition wall space.

5. The liquid ejection head according to claim 4, wherein a bottom surface of the in-partition wall space, which is a lower side in a gravity direction when the liquid ejection head is used, is formed to be inclined downward in the gravity direction during the use, toward the liquid storage portion.

6. The liquid ejection head according to claim 4, further comprising:

a cooling mechanism that cools the liquid storage portion.

7. The liquid ejection head according to claim 1, wherein the in-partition wall space is a sealed space.

8. The liquid ejection head according to claim 4, wherein the in-partition wall space and the liquid storage portion form a sealed space as a whole.

9. The liquid ejection head according to claim 1, further comprising:

a pump that communicates with the in-partition wall space and performs suction.

10. The liquid ejection head according to claim 4, further comprising:

a pump that is connected to the liquid storage portion to communicate with the in-partition wall space and perform suction; and a sensor that is provided in the liquid storage portion, wherein drive of the pump is controlled by the sensor.

11. The liquid ejection head according to claim 10, wherein a multi-directional on-off valve is provided on an inlet side of the pump so that the pump is capable of communicating with a plurality of the in-partition wall spaces.

12. The liquid ejection head according to claim 11, wherein the multi-directional on-off valve also communicates with a bubble storage space for storing bubbles generated in the liquid.

13. The liquid ejection head according to claim 1, wherein the in-partition wall space is provided with a separation wall for partially separating the in-partition wall space.

14. A liquid ejection head configured by bonding a plurality of substrates, the head comprising:

an ejection orifice from which a liquid is ejected;

a first flow passage which penetrates a bonding surface between the plurality of substrates and through which a liquid flows;

a second flow passage which penetrates the bonding surface and through which a liquid different from the liquid flowing through the first flow passage flows;

an in-partition wall space which is provided in a partition wall for separating the first flow passage and the second flow passage and is open to the bonding surface; and a liquid storage portion that stores the liquid flowing into the in-partition wall space and communicates with the in-partition wall space, wherein the in-partition wall space is formed to be inclined downward in a gravity direction when the liquid ejection head is used, toward the liquid storage portion in the substrate located on a lower side of the bonding surface in the gravity direction when the liquid ejection head is used.

15. A liquid ejection device comprising:

the liquid ejection head comprising an ejection orifice from which a liquid is ejected;

a first flow passage which penetrates a bonding surface between the plurality of substrates and through which a liquid flows;

a second flow passage which penetrates the bonding surface and through which a liquid different from the liquid flowing through the first flow passage flows; and an in-partition wall space which is provided in a partition wall for separating the first flow passage and the second flow passage and is open to the bonding surface, wherein an internal pressure of the in-partition wall space is lower than any of pressures of the liquids in the first flow passage and the second flow passage, the liquid ejection device further comprises a holding unit that holds the liquid ejection head.

* * * * *